United States Patent [19]

Panick et al.

[11] 4,309,153

[45] Jan. 5, 1982

[54] ELECTROMAGNETIC FUEL DELIVERY AND METERING PUMP

[75] Inventors: Karl Panick, Planegg; Joseph Glass, Ottobrunn, both of Fed. Rep. of Germany

[73] Assignee: Webasto-Werk W. Baier GmbH & Co., Munich, Fed. Rep. of Germany

[21] Appl. No.: 58,622

[22] Filed: Jul. 18, 1979

[30] Foreign Application Priority Data

Jul. 18, 1978 [DE] Fed. Rep. of Germany ..... 2831437

[51] Int. Cl.[3] ..... F04B 3/00; F04B 17/04

[52] U.S. Cl. ..... 417/252; 417/253; 417/418

[58] Field of Search ..... 417/413, 417, 418, 259, 417/260, 252, 253, 264, 328, 402, 251

[56] References Cited

U.S. PATENT DOCUMENTS

| | | | |
|---|---|---|---|
| 862,867 | 8/1907 | Eggleston | 417/390 |
| 947,613 | 1/1910 | Gathmann | 417/252 |
| 2,293,684 | 8/1942 | Holthouse | 417/259 |
| 2,801,591 | 8/1957 | Parker | 417/417 |
| 2,841,085 | 7/1958 | Evans | 417/257 |

*Primary Examiner*—William L. Freeh

*Attorney, Agent, or Firm*—Craig and Antonelli

[57] ABSTRACT

An electromagnetic fuel delivery pump is formed by a combination of a diaphragm pump and a metering pump. Each of the pumps have working chambers and flow control valves are arranged to enable interconnection of the working chambers when the diaphragm pump executes a delivery stroke and the metering piston pump executes a suction stroke. In a preferred embodiment, a diaphragm of the diaphragm pump is disposed directly on an extension of a piston of the metering piston pump, which piston is connected with an armature of an electromagnet that produces the delivery stroke of the piston metering pump and the suction stroke of the diaphragm pump. The delivery stroke of the diaphragm pump and the suction stroke of the piston metering pump are executed under the influence of a common return spring.

7 Claims, 2 Drawing Figures

ELECTROMAGNETIC FUEL DELIVERY AND METERING PUMP

BACKGROUND AND SUMMARY OF THE INVENTION

For metering liquid fuels, piston pumps are customarily used because essentially it is only with piston pumps that fuels of pronouncedly different viscosities can be volumetrically metered. There are considerable practical problems with these piston pumps however, so that in general a disturbance-free operation is not ensured. In the first place, these metering pumps can only overcome low suction heads. Particularly in the case of fuels with a low boiling point, even at a suction head of a few centimeters, vapor bubbles occur in large numbers, whereby the amount delivered and also the hydraulic efficiency is substantially reduced. Depending upon the design and environmental conditions, the effect of vapor bubbles can be so great that the hydraulic efficiency will drop to zero.

Another drawback of these pumps, particularly in pumping fuels with a low boiling point, is the great dependency of the quantity that is pumped upon ambient temperature. These pumps always have to be mounted in the coldest possible place in the vehicle, and this often leads to difficulties and to faulty assembling. With ambient temperatures above 10° C., the proportion of vapor bubbles increases, and the low suction power is further deteriorated. Similar difficulties also occur in the case of conduit lengths of several meters, which are usual in practice. Moreover, the filling time for dry conduits is considerable because the hydraulic efficiency of these pumps is very low if they have to drive gas. To obviate the difficulties that have been described, a second pump is often introduced upstream of the metering pump. This second pump is generally a diaphragm pump with its own electric drive. In this way increased conduit resistance is supposed to be compensated, excessive filling times in starting operation with lines that are still dry are to be avoided, and greater suction heads are obtained. However, it has been found that as before, the amount delivered to the metering pump is strongly dependent upon the pumping head. A change in the head by changing the liquid level in the storage tank produces unacceptable changes in the delivered quantities. The problems that arise when the ambient temperature is high are not solved by the upstream second pump either. The amount supplied by the diaphragm stage cannot be processed further in the heated metering stage. This means that with this solution also, the metering pump has to be mounted in a location that is as cool as possible.

The invention concerns the problem of producing an electromagnetic fuel delivery and metering pump in which the metered volume will remain constant even with long conduit lengths, up to 10 m for example, with suction heads up to 1 m for example, and ambient temperatures of 60° for example. It is a further problem of the invention, to produce a pump of this type with the least possible number of individual parts.

The problem is solved according to the invention by a pump that presents a diaphragm pump that delivers in excess and a metering piston pump, whereof the working chambers can be interconnected when the diaphragm pump executes its delivery stroke and the metering pump executes its suction stroke. The piston of the piston metering pump is connected with an armature of an electromagent, and a common return spring is provided for the delivery stroke of the diaphragm pump and the suction pump of the piston metering pump.

An excess volume of fuel is sucked from the storage tank via the diaphragm pump. This excess can be adjusted as required as a function of the given diameter, over the diaphragm stroke. The physical properties of the fuel, the ambient temperature and the flow resistance of the pump circuit govern this adjustment. This excess is guaranteed in all operational states so that fluid is always presented to the metering stage. The diaphragm sucks the medium to be delivered via a suction valve and sends it via a pressure valve and a connecting conduit into a liquid store upstream of the metering stage. Both valves are necessary, to make the metering stage as independent as possible of resistance of the pump circuit, and to ensure capability for driving gas.

Suction through the pistion metering pump from the liquid store is from a lower region, whereas the return flow to the tank is from an upper region of the store. In this way it is ensured that any vapor bubbles that may be present in the storage tank will be separated out and cannot be sucked by the metering piston pump. Alternatively, the piston metering pump can also suck directly from the working chamber of the diaphragm pump via a suction valve. In this way the diaphragm of the diaphragm pump can be disposed directly on an extension of the piston of the metering piston pump. The end of the piston extension that penetrates into the working chamber of the diaphragm pump can be applied in a known way by the return spring against a seal in the inoperative position of the pump, whereby a tank cutoff is obtained, to prevent emptying of the tank in the inoperative state when the tank is high up in its disposition.

With the disposition of the diaphragm on an extension of the piston of the metering piston pump, the suction stroke of the diaphragm pump necessarily is executed together with the delivery stroke of the metering piston pump. In order, however, to allow an independent adjustment of the delivered volumes from the diaphragm pump and the metering piston pump, the diaphragm can be impinged upon by a special spring for execution of the suction stroke. If independently adjustable means are provided for limiting the piston movement in both directions, there can be adjustment on the one hand of the delivery stroke of the diaphragm pump effected by the common return spring, and on the other hand of the delivery stroke of the piston of the metering piston pump. The common return spring has an appropriate force to overcome the counter force of the spring that executes the suction stroke of the diaphragm pump. Accordingly, this latter spring can only act when voltage is applied to the magnetic coil and the piston of the metering piston pump moves.

When the piston of the metering piston pump moves with voltage applied to the magnetic coil, the medium present in the pump chamber will be thrust out via a pressure valve, to the consumer. After the switching off of the magnetic coil, the return spring pushes the piston back again into its starting position, and thereby the suction valve of the metering piston pump opens and the medium is sucked from the volume delivered by the diaphragm pump.

Because of the great delivery capacity of the diaphragm pump, the suction lines and possibly the storage chamber are rapidly filled with liquid.

Particularly in the case of fuels with low boiling point, there are always vapor bubbles in the suction line and in the valves. These bubbles are forced through the diaphragm into the liquid store and are separated here. The metering piston pump therefore always sucks liquid only. The diaphragm pump ensures not only a constant upstream pressure of the metering piston pump, but because of the liquid excess that can be selected, intrinsic heat and external heat is also carried off. Consequently, the tendency to bubble formation is substantially reduced even when the ambient temperatures are high. Since the diaphragm of the diaphragm pump is moved at least in one direction together with the piston of the metering piston pump, no special drive is necessary for the diaphragm pump. Hereby the simplification and cost reduction that are sought are obtained.

In the reflux conduit through which the fuel that was delivered in excess is carried back to the tank, according to a preferred embodiment, a check valve is provided and upstream of this check valve there is a surge tank. With such an arrangement, fluctuations in pressure on the suction side of the metering piston pump will be damped. These pressure fluctuations occur because of pulsed flows that are produced by the diaphragm and the piston. The check valve suppresses fluctuations in pressure that could occur in the reflux conduit. Such pressure fluctuations can allow the occurrence of different pressures because of a varying level in the storage tank, and without the check valve these differences in pressure would act directly on the suction side of metering piston pump. Instead of a check valve there could also be a choke, which has a similar effect.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
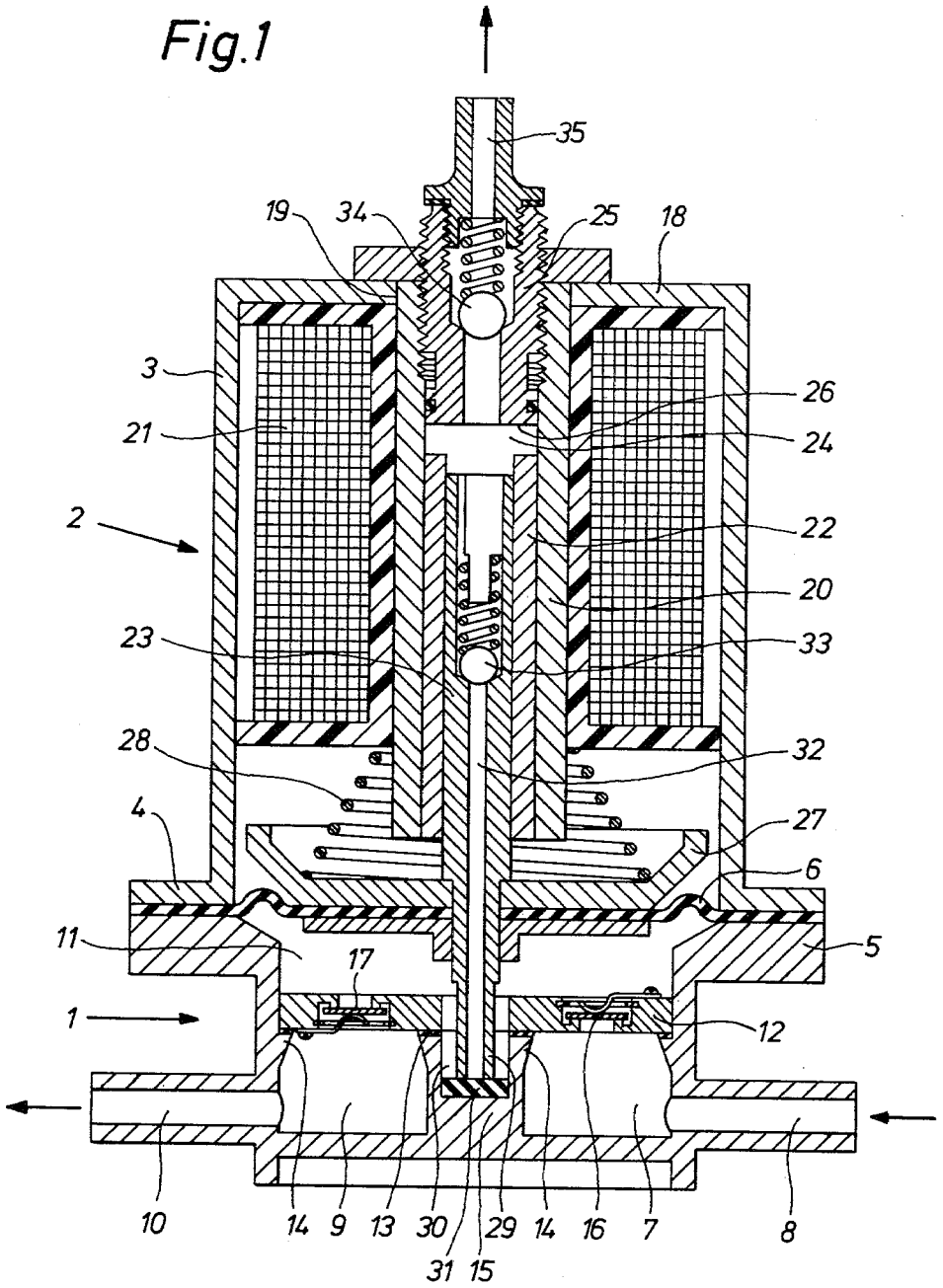
FIG. 1 shows a longitudinal section through a combined diaphragm and metering piston pump according to a first example of embodiment of the invention.

Reference is made first to FIG. 1. The diaphragm pump is designated 1, and the metering piston pump is 2. The two pumps are disposed in a common housing with a pot-shaped part 3 and a peripheral flange 4 and a cover 5 screwed onto the said flange 4. Between peripheral flange 4 and cover 5, diaphragm 6 of the diaphragm pump is clamped. Cover 5 contains a suction chamber 7 that is connected via a suction connection 8 with the storage receptacle, which is not illustrated, and a pressure chamber 9 that is connected via a pressure connection 10 with a reflux line that leads back to the storage receptacle. Chambers 7 and 9 are separated from working chamber 11 of diaphragm pump 1 by a plate 12 which is applied via a packing 13 on shoulders 14 on the walls of chambers 7 and 9, and screwed onto a barrier 15 that separates suction chamber 7 from pressure chamber 9. Opposedly acting spring biased check valves 16 and 17 are disposed in plate 12: by these valves, working chamber 11 is connected on the one hand with suction chamber 7 and on the other hand with pressure chamber 9.

Floor 18 of the pot-shaped housing part 3 has a central opening 19 in which tube 20 of permeable material that penetrates into the interior of housing part 3 is introduced. Surrounding this tube 20 there is the coil 21 of an electromagnet, in housing part 3. A sleeve 22 of non magnetic material, e.g. brass, is set in tube 20, in which sleeve piston 23 of metering piston pump 2 is slidable. Working chamber 24 of metering piston pump 2 is limited by an inset piece 25 that can be screwed into tube 20 from above. The lower end 26 of this inset piece 25 forms a stop for piston 23. Therefore, the piston stroke and therewith the volume delivered by the metering piston pump can be varied, by appropriate screwing in or out of inset piece 25.

Piston 23 is fixedly connected with the armature plate 27 of the electromagnetic as well as with diaphragm 6. Numeral 28 designates a common return spring that bears on armature plate 27. Piston 23 extends through diaphragm 6 into the working chamber 11 of the diaphragm pump. Its lower end 29 extends into a depression 30 in barrier 15, which depression is connected with working chamber 11, and in the inoperative state of the pump it is applied to a seal 31. Piston 23 has a longitudinal bore 32 that is controlled by a spring-biased suction valve 33. The spring-biased pressure valve 34 of metering piston pump 2 is disposed in inset piece 25. It controls delivery conduit 35 that leads to the consumer, e.g. to the burner of a vehicle supplementary heating instrument.

The operation of the illustrated combined diaphragm and piston pump is as follows.

When voltage is applied to coil 21 of the electromagnet, the armature plate 27 in the drawing will be drawn upward to close the magnetic flow of force running from housing 3 which consists of permeable material, via tube 20 and armature plate 27. Armature plate 27 carries piston 23 along, and also diaphragm 6 therewith, with the result that the fuel in working chamber 24 of piston pump 2 will be thrust out through conduit 35, while at the same time fuel will be sucked into working chamber 11 of diaphragm pump 11 from suction chamber 7, through check valve 16 that opens. If now current delivery to coil 21 is interrupted, return spring 28 moves armature 27 downward, whereby diaphragm 6 executes its delivery stroke and piston 23 executes its suction stroke. During this suction stroke, fuel is sucked from working chamber 11 through passage 32 and suction valve 33 that opens, into working chamber 24 of piston pump 2. By appropriate design of the spring loading of check valve 17 and the cross-section of reflux conduit 10, the arrangement will be such that the suction will be effected with a certain upstream pressure. Any vapor bubbles that may be present in the fuel sucked by diaphragm pump 1 can in no case reach piston pump 2 because the suction occurs from the deepest part of working chamber 11.

The electric pulses for coil 21 of the electromagnet are produced in the conventional way by a pulse generator that is controlled according to the desired delivery volume of metering piston pump 2.

Figure 2:
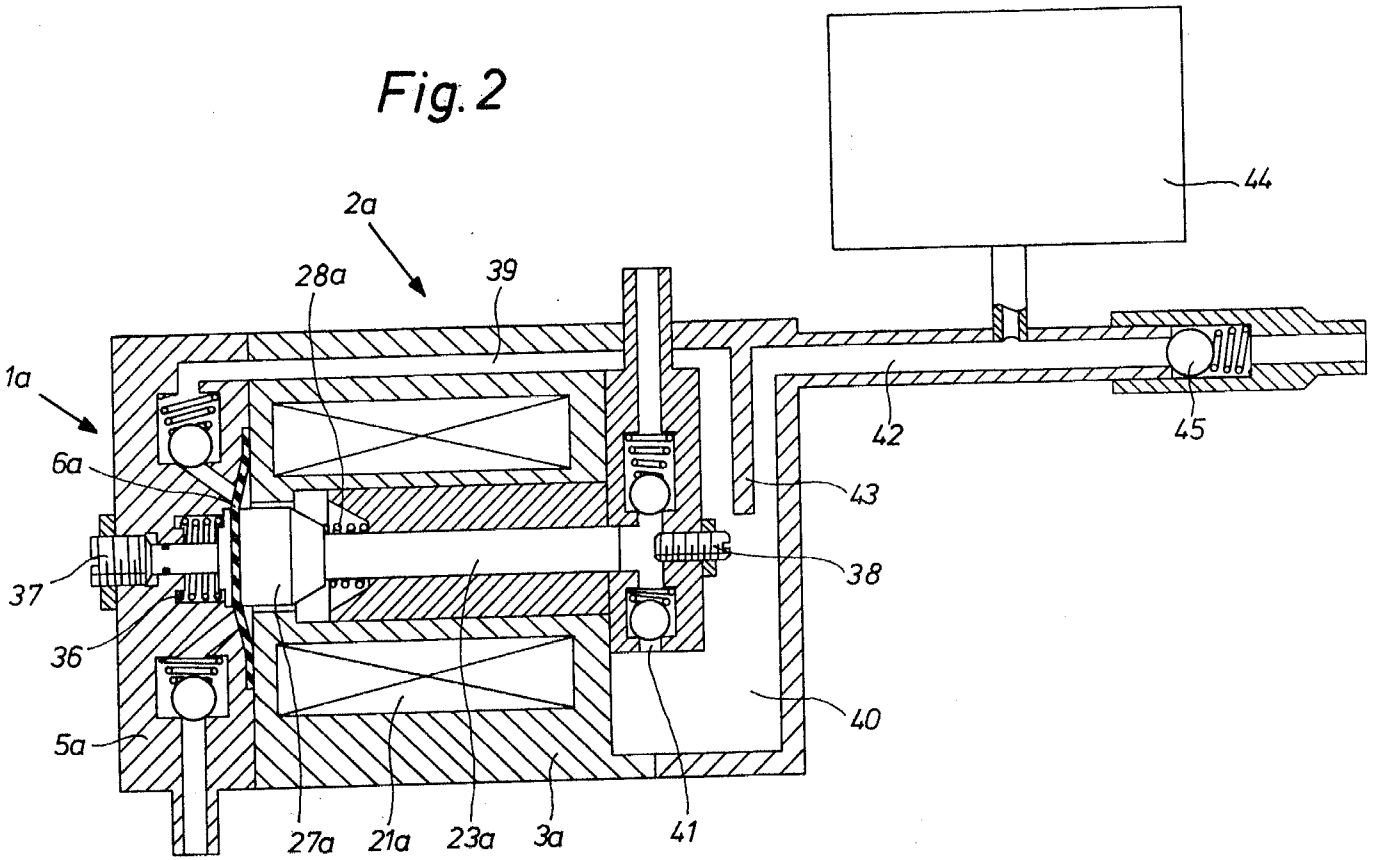
FIG. 2 is a longitudinal section through a combined diaphragm metering piston pump according to a second example of embodiment of the invention.

The same reference numerals are used in FIG. 2 for the same or similar parts as in FIG. 1, but with the index a. As distinguished from the embodiment of FIG. 1, in the example of FIG. 2 there is first the difference that piston 23*a* and armature 27*a* are not fixedly connected with diaphragm 6*a*, and a special spring 36 is provided for the suction stroke of diaphragm pump 1*a*. The delivery stroke of diaphragm pump 1*a* on the other hand is effected in the same way as in the example of FIG. 1 by the common return spring 28*a*. This separation of diaphragm 6*a* from piston 23*a* makes possible a separate adjustment of the delivery volumes of diaphragm pump 1*a* and piston pump 2*a*. An adjusting screw 37 is provided for this purpose in the cover 5*a* of the housing, this screw limiting the delivery stroke of diaphragm 6*a*. On the other side, the delivery stroke of piston 23*a* is limited by an adjusting screw 38 which corresponds in its effect to inset piece 25 of FIG. 1.

The guiding of the fuel inside the combined pump differs from that of the example according to FIG. 1. Delivery conduit 39 of diaphragm pump 1*a* leads to a liquid storage chamber 40 in housing part 3*a*, from which metering piston pump 2*a* sucks via its suction line 41. The suction occurs in the lower region of storage chamber 40, to prevent sucking of vapor bubbles in a reliable manner. A reflux conduit 42 leads from the upper region of store 40 back to the reservoir tank. A separating wall 43 in the storage chamber 40 ensures complete separation of any vapor bubbles that may be present.

A surge tank 44 is connected to reflux conduit 42, and downstream of this surge chamber there is a check valve 45 disposed in reflux conduit 41. Surge tank 44 damps fluctuations of pressure on the suction side of metering pistion pump 2*a* that may occur from pulsed flows that can be caused by diaphragm 6*a* and piston 23*a*. Check valve 45 suppresses the effect of pressure fluctuations in the reflux conduit on the suction side of the metering piston pump. Such fluctuations of pressure in reflux conduit 41 can occur from change of level in the storage tank. Instead of check valve 45 there could also be provision of a choke that damps the pressure fluctuations that have been mentioned.

In the example of embodiment according to FIG. 2 there is an especially intensive cooling of the metering piston pump 2*a*, ensured by the storage chamber 40 through which the fuel flows. In addition, a heating of the fuel sucked directly from the metering piston pump 2*a* is prevented, which in the example according to FIG. 2 can occur from the current heat of coil 21*a* and the heating of piston 23*a* that is thereby effected.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Electromagnetic fuel delivery pump, comprising a diaphragm pump that delivers in excess and a metering piston pump, said pumps having working chambers and means enabling interconnection thereof when the diaphragm pump executes a delivery stroke and the metering piston pump executes a suction stroke, said metering piston pump having a piston formed with an extension that is connected with an armature plate of an electromagnet and with a diaphragm of the diaphragm pump, said extension extending through said diaphragm into the working chamber of the diaphragm pump, the interconnection means comprising a bore within which a suction valve is disposed that penetrates lengthwise through the piston and its extension so as to open into the working chamber of the diaphragm pump, and a common return spring being provided for executing the delivery stroke of the diaphragm pump and the suction stroke of the piston metering pump, said return spring bearing on said armature plate.

2. Electromagnetic fuel delivery pump as in claim 1, wherein the diaphragm pump, the metering piston pump and coils of the electromagnet are disposed in a common housing.

3. Electromagnetic fuel delivery pump, comprising a diaphragm pump that delivers in excess and a metering piston pump, said pumps having working chambers and means enabling interconnection thereof when the diaphragm pump executes a delivery stroke and the metering piston pump executes a suction stroke, said metering piston pump having a piston connected with an armature of an electromagnetic, and a common return spring being provided for executing the delivery stroke of the diaphragm pump and the suction stroke of the piston metering pump, wherein a diaphragm of the diaphragm pump is disposed directly on an extension of the piston of the metering piston pump, wherein the piston and its extension have a penetrating lengthwise bore in which a suction valve is disposed, opening into the working chamber of the diaphragm pump, and wherein an end of the piston extension that penetrates into the working chamber of the diaphragm pump is pressed in the inoperative position of the pump against a seal by the return spring.

4. Electromagnetic fuel delivery pump as in claim 1, wherein said common return spring is mounted about said piston with a displaceable end thereof in abutment with said armature.

5. Electromagnetic fuel delivery pump, comprising a diaphragm pump that delivers in excess and a metering piston pump, said pumps having working chambers and means enabling interconnection thereof when the diaphragm pump executes a delivery stroke and the metering piston pump executes a suction stroke, said metering piston pump having a piston formed with an extension that is connected with an armature of an electromagnet and with a diaphragm pump, and a common return spring being provided for executing the delivery stroke of the diaphragm pump and the suction stroke of the piston metering pump, said return spring being mounted about said piston with a displaceable end thereof in abutment with said armature, wherein the diaphragm pump, the metering piston pump and coils of the electromagnet are disposed in a common housing, and wherein a suction chamber and a pressure chamber in said housing communicate with the working chamber of the diaphragm pump via respective oppositely acting check valves, whereby a quantity of fluid drawn in by the diaphragm from said suction chamber during its suction stroke in excess of that which is delivered to the metering pump during the delivery stroke of the diaphragm pump is discharged to said pressure chamber.

6. Electromagnetic pump according to claim 5, wherein said oppositely acting check valves are located in a valve plate separating said pressure and suction chambers from the working chamber of the diaphragm pump.

7. Electromagnetic fuel delivery pump as in claim 5 or 6, wherein the piston and its extension have a penetrating lengthwise bore in which a suction valve is disposed, opening into the working chamber of the diaphragm pump, and wherein an end of the piston extension that penetrates into the working chamber of the diaphragm pump is pressed in the inoperative position of the pump against a seal by the return spring.

* * * * *